US010880648B2

(12) United States Patent
Willems

(10) Patent No.: US 10,880,648 B2
(45) Date of Patent: Dec. 29, 2020

(54) LOUDSPEAKER ASSEMBLIES AND ASSOCIATED METHODS

(71) Applicant: PSS BELGIUM NV, Dendermonde (BE)

(72) Inventor: Stefan Willems, Dendermonde (BE)

(73) Assignee: PSS BELGIUM NV, Dendermonde (BE)

( * ) Notice: Subject to any disclaimer, the term of this patent is extended or adjusted under 35 U.S.C. 154(b) by 217 days.

(21) Appl. No.: 16/062,740

(22) PCT Filed: Nov. 24, 2016

(86) PCT No.: PCT/EP2016/078631

§ 371 (c)(1),
(2) Date: Jun. 15, 2018

(87) PCT Pub. No.: WO2017/102278

PCT Pub. Date: Jun. 22, 2017

(65) Prior Publication Data

US 2020/0169808 A1 May 28, 2020

(30) Foreign Application Priority Data

Dec. 15, 2015 (GB) ..... 1522136.9

(51) Int. Cl.
*H04R 3/12* (2006.01)
*H04R 1/02* (2006.01)
(Continued)

(52) U.S. Cl.
CPC ..... *H04R 3/12* (2013.01); *H04R 1/025* (2013.01); *H04R 1/403* (2013.01); *H04R 7/12* (2013.01);
(Continued)

(58) Field of Classification Search
CPC ..... H04R 2203/12; H04R 3/12; H04R 1/403; H04R 1/025; H04R 7/12; H04R 7/18;
(Continued)

(56) References Cited

U.S. PATENT DOCUMENTS 5,809,150 A 9/1998 Eberbach
5,809,153 A 9/1998 Aylward et al.
(Continued)

FOREIGN PATENT DOCUMENTS

EP 2891338 3/2014
JP 2000295686 A 10/2000
WO WO2009012499 A1 1/2009

OTHER PUBLICATIONS

ISA/EP, International Search Report and Written Opinion for PCT Patent Application No. PCT/EP2016/078631, dated Feb. 7, 2017.
Reproduced Sound 16 Conference, Stratford upon Avon (UK), Nov. 17-19, 2000, Institute of Acoustics, "Optimizing directivity properties of DSP controlled loudspeaker arrays".
UKIPO, Search Report for UK Patent Application No. 1522136.9, dated Feb. 8, 2016.
(Continued)

*Primary Examiner* — David L Ton
(74) *Attorney, Agent, or Firm* — NK Patent Law

(57) ABSTRACT

A loudspeaker assembly comprising: a first loudspeaker configured to receive a first electrical signal, and to produce sound along a first principal radiating axis based on the first electrical signal; a second loudspeaker configured to receive a second electrical signal, and to produce sound along a second principal radiating axis based on the second electrical signal; a third loudspeaker configured to receive a third electrical signal, and to produce sound along a third principal radiating axis based on the third electrical signal; and a control unit configured to produce each of the first, second and third electrical signals based on an input signal representative of audio. There is a first angular offset between the first and second principal radiating axes and a second angular offset between the first and third principal radiating axes.

12 Claims, 7 Drawing Sheets

(51) Int. Cl.

| | |
|---|---|
| ***H04R 1/40*** | (2006.01) |
| ***H04R 7/12*** | (2006.01) |
| ***H04R 7/18*** | (2006.01) |
| ***H04R 9/02*** | (2006.01) |
| ***H04R 9/06*** | (2006.01) |
| ***H04R 29/00*** | (2006.01) |

(52) U.S. Cl.
CPC ..... *H04R 7/18* (2013.01); *H04R 9/025* (2013.01); *H04R 9/06* (2013.01); *H04R 29/002* (2013.01); *H04R 2201/403* (2013.01); *H04R 2400/11* (2013.01); *H04R 2430/01* (2013.01)

(58) Field of Classification Search
CPC ..... H04R 9/025; H04R 9/106; H04R 9/06; H04R 2201/403; H04R 2400/01; H04R 2430/01
See application file for complete search history.

(56) References Cited

U.S. PATENT DOCUMENTS

| | | | | |
|---|---|---|---|---|
| 5,870,484 | A | 2/1999 | Greenberger | |
| 2004/0109570 | A1 | 6/2004 | Bharitkar et al. | |
| 2008/0273722 | A1 | 11/2008 | Aylward et al. | |
| 2012/0039480 | A1* | 2/2012 | Willems ..... | H04R 3/12 381/71.1 |
| 2013/0279716 | A1 | 10/2013 | Hartung et al. | |

OTHER PUBLICATIONS

EPO, Examination Report in European Application No. 16 800 982.7-1207 dated Aug. 7, 2020, pp. 1-10.
CNIPA, Second Office Action in Chinese Application No. 2016800747549 dated Sep. 1, 2020, pp. 1-16.

* cited by examiner

Response of loudspeaker under angle is equivalent as filtered response of the loudspeaker on axis

LOUDSPEAKER ASSEMBLIES AND ASSOCIATED METHODS

CROSS REFERENCE TO RELATED APPLICATION(S)

This application is a 371 National Phase Application of PCT Patent Application No. PCT/EP2016/078631 filed on Nov. 24, 2016, which claims priority to United Kingdom Patent Application No. 1522136.9 filed on Dec. 15, 2015, the entire content of all of which is incorporated by reference herein.

FIELD OF THE INVENTION

This invention relates to loudspeaker assemblies and associated methods.

BACKGROUND

Loudspeaker assemblies are often used in applications such as in home cinema, consumer electronics and automotive. In such applications, it is advantageous to direct the sound from the loudspeaker assembly in a particular direction, for example towards a listening position where it is expected that a person listening to the sound from the loudspeaker assembly will be located.

In such applications, it is advantageous to be able to project sound in a particular direction (in particular, to create sound of a high directivity), so that sound is not wasted by sending it to areas where it is not needed. Furthermore, in applications where the speaker assembly is are required to play music, TV audio or film audio, the sound to be projected to a listener may incorporate a large range of sound frequencies. Hence, it is necessary for a loudspeaker assembly to produce high directivity sound over a wide range of frequencies, such that the full range of frequencies can be directed to the listener.

Commonly, loudspeaker assemblies used in applications such as home cinema, consumer electronics and automotive are small, for example due to space constraints and/or cost constraints. Loudspeaker assemblies of a small size often suffer in that they are less effective at generating low-frequency sounds, owing to the small size of the speaker driver. Hence, the requirement to create highly directive sound at the low end of the audio frequency range is increased for small speaker units.

The directivity of a loudspeaker relates to the distribution of the acoustic output (sound) from that loudspeaker, and may be defined in terms of a directivity index (e.g. as defined below). Loudspeakers with a high directivity index project sound preferably in a given direction or directions, whilst loudspeakers with a low directivity index tend to project sound more isotropically (equally in all directions)

In many situations that involve an enclosed space, for example in a room of a house or in a car, it is preferable for a loudspeaker to have a high directivity index, such that sound is projected towards a listening position where the sound is needed (for example to a driver of a car), rather than wasting energy by projecting the sound to positions where it is not needed.

Traditional loudspeakers, such as cone speakers, have some directivity by virtue of the coned speaker diaphragm, and owing to the fact that they are often housed in a way that prevents sound from escaping from a back of the loudspeaker.

The directivity of a loudspeaker assembly that includes an array of multiple loudspeakers can be greatly improved over that of a single speaker, by using a series of speakers in combination. In particular, by driving the array of loudspeakers with electrical signals that are filtered so that there are differences in gain and/or phase between the electrical signals, it is possible to achieve a speaker assembly output with a high directivity, for example which projects sound primarily in a given direction.

FIG. 1(*a*) shows a simple loudspeaker assembly referred to as a cardioid loudspeaker assembly 1001, that includes an array of two loudspeakers L1, L2 each configured to produce sound S1, S2 along a respective principal radiation axis X1, X2. The loudspeakers L1, L2 are mounted with an angular offset between their principal radiation axes X1, X2. Each loudspeaker L1, L2 is configured to receive a respective electrical signal E1, E2 from a control unit 1020, which produces each of the electrical signals E1, E2 based on an input signal $A_{in}$ representative of audio. The loudspeakers L1, L2 include a primary speaker L1 which receives an unfiltered electrical signal E1 and an auxiliary loudspeaker L2 that receives an electrical signal E2 that is filtered with respect to the electrical signal E1 received by the primary loudspeaker L1 such that there is a gain and phase difference between the electrical signals E1, E2 received by the loudspeakers L1, L2 (the signal processing to achieve the gain and phase difference may include e.g. a signal inverter, a delay and a gain). In particular, the auxiliary loudspeaker L2 is driven by an electrical signal E2 that is filtered with a defined gain and phase difference from the electrical signal E1 received by the primary loudspeaker L1 such that direct sound S1, S2 produced by the loudspeakers L1, L2 cancel each other at a listening position P1.

FIG. 1(*b*) is a series of 2D polar plots showing the direct sound (sound pressure level) produced by the cardioid loudspeaker assembly 1001 of FIG. 1(*a*) at different frequencies. The sound has a polar pattern in the shape of a cardioid, with the direct sound produced by the cardioid loudspeaker assembly cancelling so as to form a "null" at the listening position P1. Note that the loudspeakers L1, L2 become more directive as frequency increases.

A typical application for a cardioid loudspeaker assembly 1001 is a so called TV "sound bar" which attempt to create a listening perception that is far broader than the apparent physical width of the sound bar. The main principle is that the listener is located at the "null" of the cardioid formed by the direct sound S1, S2, so that little direct sound is heard at the listening position P1, but reflected (indirect) sound is instead heard at the listening position P1 after having been reflected from nearby walls. It is known that a reflection from a wall can act as a virtual sound source, so that a listener perceives sound from a virtual loudspeaker that is attached at the reflection point. Hence, a cardioid loudspeaker assembly 1001, able to produce a high directivity acoustic output over a large space, is desirable to meet performance and cost requirements of a sound bar. A cardioid loudspeaker assembly 1001 could be referred to as a hyper directive system, since it typically uses loudspeakers that are highly directive.

The present inventors have observed that as the null of a cardioid loudspeaker assembly 1001 is rather narrow, the "sweet spot" whereby sound is dominated by reflected sound rather than direct sound is rather restricted. The present inventors have also observed that the polarity of the acoustic waves produced by a cardioid loudspeaker assembly 1001 changes when the listener turns around the cardioid.

It is known that directive loudspeaker arrays can be made by using a large number of loudspeaker units (typically 10 or more) mounted to have parallel principal radiating axes, with each loudspeaker being fed by an appropriate electrical signal, that is basically a delayed and/or filtered and gained replica of an input signal, see e.g. "Optimizing directivity properties of DSP controlled loudspeaker arrays", G. W. J. van Beuningen, E. W. Start, Presented at "Reproduced Sound 16 Conference", Stratford upon Avon (UK), 17-19 Nov. 2000, Institute of Acoustics. However these systems have a high cost.

The present invention has been devised in light of the above considerations.

SUMMARY OF THE INVENTION

A first aspect of the invention may provide:

A loudspeaker assembly comprising:

a first loudspeaker configured to receive a first electrical signal, and to produce sound along a first principal radiating axis based on the first electrical signal;

a second loudspeaker configured to receive a second electrical signal, and to produce sound along a second principal radiating axis based on the second electrical signal;

a third loudspeaker configured to receive a third electrical signal, and to produce sound along a third principal radiating axis based on the third electrical signal; and a control unit configured to produce each of the first, second and third electrical signals based on an input signal representative of audio;

wherein there is a first angular offset between the first and second principal radiating axes and a second angular offset between the first and third principal radiating axes;

wherein the control unit is configured to filter at least two of the first, second and third electrical signals so that there is a first gain and phase difference between the first and second electrical signals and a second gain and phase difference between the first and third electrical signals;

wherein the first and second angular offsets and the first and second gain and phase differences are configured so that, when the loudspeaker assembly is in use, direct sound produced by multiple loudspeakers in the loudspeaker assembly is cancelled in accordance with a predetermined cancelling condition at each of a first listening position and a second listening position.

In this way, when the loudspeaker assembly is used in an enclosed space, any audience member(s) located at the first or second listening position, or to a lesser extent between such positions, will, due to the cancellation of direct sound produced by the loudspeaker at the first and second listening positions, receive an increased proportion of sound indirectly from reflections of the sound off walls at the periphery of the enclosed space. Such reflections can acts as virtual sound sources, thereby improving the listening experience of the audience member(s).

For the avoidance of any doubt, the multiple loudspeakers in the loudspeaker assembly that produce direct sound that is cancelled in accordance with a predetermined cancelling condition at a given listening position (when the loudspeaker is in use) may include loudspeakers in the loudspeaker assembly that are present in addition to the first, second and third loudspeakers (see e.g. the discussion of FIG. 4 below, where in Step 4 cancellation at P2 is in part obtained through direct sound produced by a fourth loudspeaker L4).

For the avoidance of any doubt, the contribution of any loudspeakers deemed to have an insignificant effect at a listening position may be ignored when evaluating whether direct sound produced by multiple loudspeakers in the loudspeaker assembly is cancelled in accordance with a predetermined cancelling condition at that listening position (see e.g. the discussion of FIG. 4 below, where the contribution of L4 is ignored at P1).

Direct sound produced by a loudspeaker in the loudspeaker assembly may be defined as sound produced by the loudspeaker that has not been reflected by an intervening surface. Direct sound can be measured, for example, in an anechoic chamber. Direct sound can also be measured, for example, in a normal (non-anechoic) environment by using a gated measurement in which reflected sound is excluded by measuring direct sound using an appropriately defined time window.

The loudspeaker assembly may include one or more additional loudspeakers.

For example, the loudspeaker assembly may include:

a fourth loudspeaker configured to receive a fourth electrical signal, and to produce sound along a fourth principal radiating axis based on the fourth electrical signal; and wherein the control unit is configured to produce the fourth electrical signal based on the input signal representative of audio;

wherein there is an third angular offset between the first and fourth principal radiating axes;

wherein the control unit is configured to filter the fourth electrical signal so that there is a third gain and phase difference between the first and fourth electrical signals;

wherein the first, second and third angular offsets and the first, second and third gain and phase differences are configured so that, when the loudspeaker assembly is in use, direct sound produced by multiple loudspeakers in the loudspeaker assembly is cancelled in accordance with a predetermined cancelling condition at each of a first listening position, a second listening position and a third listening position.

A loudspeaker assembly that includes four loudspeakers may be particularly useful if the loudspeaker assembly is intended to provide stereophonic sound. However, it is also possible to have a loudspeaker assembly that includes only three loudspeakers.

The loudspeakers included in the loudspeaker assembly may be arranged with their principal radiating axes symmetrically arranged in relation to a plane of symmetry, which may be a vertical plane of symmetry when the loudspeaker assembly is in use. Again, this may be useful if the loudspeaker assembly is intended to provide stereophonic sound.

A principal radiating axis of a loudspeaker may be defined as an axis along which the loudspeaker produces direct sound at maximum amplitude (sound pressure level). A loudspeaker having a principle radiating axis may be referred to as a directional loudspeaker.

The extent to which a loudspeaker is directional may be defined by a directivity index. For the purposes of this disclosure, the directivity index (DI) of a loudspeaker at a given frequency (f) may be defined in dB as:

$$DI=10\log_{10}H_0(f)/\overline{H(f)}$$

where $H_0(f)$ is an "on axis" sound pressure level as measured on the principal radiating axis, and $\overline{H(f)}$ is an average "off axis" sound pressure level as measured off the principal radiating axis. The "on axis" and "off axis" sound pressure levels may be measured at a standard distance from the loudspeaker, e.g. 1 metre.

By nature, DI tends to increase with frequency, since loudspeakers tend to be more directive at higher frequencies (as can be seen from some of the figures discussed below).

In general, it is not possible/practical to measure H(f) for all directions, so $\overline{H(f)}$ is usually approximated in practice according to a defined technique.

There are many techniques that can be used to approximate $\overline{H(f)}$, see e.g. "On the Calculation of Full and Partial Directivity Indices", Technical Report, Tylka, 16 Nov. 2014 3D Audio and Applied Acoustics Laboratory, Princeton University.

For the purposes of this disclosure, $\overline{H(f)}$ may be approximated using the average of four "off axis" measurements taken within a plane at angles of 15°, 30°, 45°, and 60° relative to a principal radiating axis of the loudspeaker. If a diaphragm of the loudspeaker has a non-constant radius (e.g. because the diaphragm has an elliptical/oval form), the plane in which the measurements are taken may be a plane in which a maximum radius of the diaphragm lies.

Preferably, each loudspeaker in the loudspeaker assembly has a directivity index (according to the above definition) that is at least 6 dB at a frequency of 3 kHz. This provides a loudspeaker with a relatively high directivity compared to loudspeakers typically used in a "soundbar", which the present inventors have found useful for achieving adequate cancellation of direct audio signals produced by the loudspeaker assembly at multiple listening positions.

For avoidance of any doubt, a gain and phase difference between two electric signals may include a difference in gain and/or a difference in phase between the two electric signals.

Preferably, each gain and phase difference is frequency dependent. For example, each gain and phase difference may be zero below a threshold frequency value, and non-zero above the threshold frequency value. This has been found to improve listener perception, since because directivity is less important at lower frequencies. The threshold frequency value may be 150 Hz.

As would be appreciated by a skilled person, perfect cancellation of direct sound produced by multiple loudspeakers at a given listening position may be very difficult, if not impossible, to achieve in practice.

Accordingly, a predetermined cancelling condition at a given listening position may be defined in such a way that does not require perfect cancellation of sound at that listening position, but might instead require cancellation that is acceptable.

Preferably, the predetermined cancelling condition at each listening position requires that, over a predetermined frequency range (which predetermined frequency range may be 200 Hz-3 kHz), the sound pressure level of direct sound produced by multiple loudspeakers in the loudspeaker assembly at the listening position is at least X dB lower than the sound pressure level of direct sound produced by a subset of the loudspeakers in the loudspeaker assembly at the listening position. X is preferably 12 dB, but may be a larger value (e.g. 15 dB). This measurement does not require a special input signal representative signal to be used. Any input signal having a frequency range of 200 Hz-3 kHz could be used for such measurements, such as a full band input signal traditionally used for loudspeaker measurements.

For avoidance of any doubt, the subset of the loudspeakers referred to in connection with the predetermined cancelling condition at a given listening position may include one or more loudspeakers, and the subset may be different for different listening positions (see e.g. the example method discussed below with reference to FIG. 4, where the subset include the loudspeaker L1 at listening positions P1 and P2, and loudspeakers L2 and L3 at listening position P3).

For avoidance of any doubt, the multiple loudspeakers referred to in connection with the predetermined cancelling condition at a given listening position, may include all loudspeakers in the loudspeaker assembly, or may include a subset of loudspeakers in the loudspeaker assembly that includes only those loudspeakers deemed to have a significant effect on the direct sound at the listening position (see e.g. the example discussed below with reference to FIG. 4, where the multiple loudspeakers includes all loudspeakers at listening position P2, but only loudspeakers L1-L3 at listening position P1 and only loudspeakers L2-L4 at listening position P3, since loudspeaker L4 was deemed to have an insignificant effect at listening position P1 and loudspeaker L1 was deemed to have an insignificant effect at listening position P3).

Techniques for measuring direct sound produced at a listening position by one or more loudspeakers are well known, but could, for example, involve supplying a test input signal (e.g. representative of audio having frequencies covering a frequency range of interest, e.g. the predetermined frequency range referred to above) to the one or more loudspeakers, and measuring the direct sound received at that listening position. As noted above, direct sound received at a listening position can be measured, for example, in an anechoic environment. Direct sound can also be measured, for example, in a normal (non-anechoic) environment by using a gated measurement in which reflected sound is excluded by measuring direct sound using an appropriately defined time window.

For avoidance of any doubt, measurements of direct sound do not require a special input signal representative signal to be used. Any input signal having a frequency range of interest could be used for such measurements, such as a full band input signal traditionally used for loudspeaker measurements.

Preferably, there is an angular offset between the principal axes of each pair of loudspeakers in the loudspeaker assembly that is at least a predetermined threshold angle. The predetermined threshold angle is preferably 15° or more, 30° or more, more preferably 45° or more, more preferably 60° or more. Having such a predetermined threshold angle has been found to permit adequate cancellation of direct sound produced by loudspeakers in the loudspeaker assembly at multiple listening positions.

In this context, each pair of loudspeakers in the loudspeaker assembly may be taken to mean each possible pair of loudspeakers in the loudspeaker assembly. So if the first, second and third loudspeakers in the loudspeaker assembly are the only loudspeakers in the loudspeaker assembly, each pair of loudspeakers would include the first and second loudspeakers, the first and third loudspeakers, and the second and third loudspeakers.

Preferably, the loudspeakers in the loudspeaker assembly are arranged so that between each pair of loudspeakers in the loudspeaker assembly there is a distance that is no more than a predetermined threshold distance. Preferably, the predetermined threshold distance is at least twice as large as a distance between one of the loudspeakers in the loudspeaker assembly and one of the listening positions. Having such a predetermined threshold distance is useful for achieving adequate cancellation of direct audio signals produced by the loudspeaker assembly at multiple listening positions.

Preferably, the predetermined threshold distance is 50 cm or less, more preferably 40 cm or less. This might be useful for a typical soundbar, for example.

A listening position may be defined relative to the loudspeaker assembly, and may represent a position where it is expected that a person listening to sound from the loudspeaker assembly will be located when the loudspeaker assembly is in use.

Preferably, the loudspeakers in the loudspeaker assembly are mounted within a single loudspeaker assembly enclosure, preferably with the listening positions located outside the loudspeaker assembly enclosure.

The loudspeakers may be arranged in a linear array (i.e. single row), or may be arranged in a non-linear array (e.g. multiple rows).

If the loudspeaker assembly includes four loudspeakers arranged in a linear array mounted within a single loudspeaker assembly enclosure, preferably the two loudspeakers on the ends of the linear array have principal radiation axes that point out from opposing side faces of the single loudspeaker assembly enclosure, with the two loudspeakers interior of the two loudspeakers on the ends of the linear array having principal radiation axes that point out of a front face of the single loudspeaker assembly enclosure, wherein the front face of the single loudspeaker assembly enclosure faces the listening positions.

For avoidance of any doubt, whilst the loudspeakers in the loudspeaker assembly may be located in the same plane, this is not a requirement of the invention, since other arrangements may be appropriate depending on the intended application of the loudspeaker assembly (e.g. if the loudspeaker assembly is intended for use in a car).

For avoidance of any doubt, whilst the loudspeakers in the loudspeaker assembly may be mounted with their principal axes in the same plane, this is not a requirement of the invention, since other arrangements may be appropriate depending on the intended application of the loudspeaker assembly (e.g. if the loudspeaker assembly is intended for use in a car).

The loudspeaker assembly enclosure may have a bar shape, e.g. such that the loudspeaker assembly provides a "soundbar".

Each loudspeaker may be an electro-dynamic loudspeaker.

Each loudspeaker may include:

- a permanent magnet assembly (e.g. comprising metal components and a permanent magnet);
- a voice coil assembly (e.g. comprising a wire referred to as a voice coil wound/wrapped around a thin tube referred to as a voice coil former);
- a diaphragm;
- a chassis;
- a suspension system which suspends the diaphragm from the chassis (e.g. including an edge suspension and a spider).

The voice coil is preferably configured to interact with a static magnetic field of the permanent magnet when an electric current is passed through the voice coil. An interaction between the voice coil and the static magnetic field of the permanent magnet preferably results in movement of the voice coil along a predetermined axis.

Preferably, each loudspeaker in the loudspeaker assembly is mounted within its own individual loudspeaker enclosure, preferably so that back radiation from each loudspeaker does not have a significant influence on other loudspeakers in the loudspeaker assembly.

Each loudspeaker may have a diaphragm that has a circular or an elliptical form.

The loudspeaker assembly enclosure may be a vented box, or a closed box.

The control unit may include a digital signal processor ("DSP"), for example.

A second aspect of the invention may provide:

A method of configuring a loudspeaker assembly comprising:

- a first loudspeaker configured to receive a first electrical signal, and to produce sound along a first principal radiating axis based on the first electrical signal;
- a second loudspeaker configured to receive a second electrical signal, and to produce sound along a second principal radiating axis based on the second electrical signal;
- a third loudspeaker configured to receive a third electrical signal, and to produce sound along a third principal radiating axis based on the third electrical signal; and
- a control unit configured to produce each of the first, second and third electrical signals based on an input signal representative of audio;
- wherein there is a first angular offset between the first and second principal radiating axes and a second angular offset between the first and third principal radiating axes;
- wherein the control unit is configured to filter at least two of the first, second and third electrical signals so that there is a first gain and phase difference between the first and second electrical signals and a second gain and phase difference between the first and third electrical signals;
- wherein the method includes adjusting the first and second angular offsets and the first and second gain and phase differences so that, when the loudspeaker assembly is in use, direct sound produced by multiple loudspeakers in the loudspeaker assembly is cancelled in accordance with a predetermined cancelling condition at each of a first listening position and a second listening position.

Adjusting an angular offset between the principal radiating axes of two loudspeakers may include changing a mounting angle of either/both of those loudspeakers in the loudspeaker assembly. The angular offsets may be adjusted from initial angular offsets corresponding to initial mounting angles of the loudspeakers in the loudspeaker assembly, wherein the initial mounting angles were chosen to provide a good starting point for obtaining cancellation of direct sound at each listening position.

Adjusting a phase and gain difference between electrical signals received by two loudspeakers may include defining a new filter/adjusting an existing filter for either/both of (the electrical signal(s) received by) those loudspeakers in the loudspeaker assembly.

The method may include any method step implementing or corresponding to any apparatus feature described in connection with any above aspect of the invention.

For example, the loudspeaker assembly may include:

- a fourth loudspeaker configured to receive a fourth electrical signal, and to produce sound along a fourth principal radiating axis based on the fourth electrical signal; and
- wherein the control unit is configured to produce the fourth electrical signal based on the input signal representative of audio;
- wherein there is an third angular offset between the first and fourth principal radiating axes;

wherein the control unit is configured to filter the fourth electrical signal so that there is a third gain and phase difference between the first and fourth electrical signals;

wherein the method includes adjusting the first, second and third angular offsets and the first, second and third gain and phase differences so that, when the loudspeaker assembly is in use, direct sound produced by multiple loudspeakers in the loudspeaker assembly is cancelled in accordance with a predetermined cancelling condition at each of a first listening position, a second listening position and a third listening position.

The method is preferably iterative, and may include measuring direct sound at each listening position, e.g. in an anechoic environment.

The method may include:

(i) at a first one of the listening positions, measuring direct sound produced by a first subset of the loudspeakers in the loudspeaker assembly and, based on the measured direct sound, adjusting one or more of the gain and phase differences so that direct sound produced by multiple loudspeakers in the loudspeaker assembly is cancelled in accordance with a predetermined cancelling condition at the first listening position;

(ii) at a second one of the listening positions, measuring direct sound produced by multiple loudspeakers in the loudspeaker assembly and evaluating whether the direct sound produced by the multiple loudspeakers is cancelled in accordance with the predetermined cancelling condition at the second listening position;

(iii) if the direct sound produced by the multiple loudspeakers is not cancelled in accordance with the predetermined cancelling condition at the second listening position, adjusting one or more of the angular offsets and returning to step (i).

As noted above, adjusting a phase and gain difference between electrical signals received by two loudspeakers may include defining a new filter/adjusting an existing filter for either/both of (the electrical signal(s) received by) those loudspeakers in the loudspeaker assembly.

If the loudspeaker assembly includes a fourth loudspeaker (see above) (and preferably where the second listening position is between the first and third listening positions), the method may further include:

(iv) at a third one of the listening positions, measuring direct sound produced by a second subset of the loudspeakers in the loudspeaker assembly and, based on the measured direct sound, adjusting the third gain and phase difference so that direct sound produced by multiple loudspeakers in the loudspeaker assembly is cancelled in accordance with a predetermined cancelling condition at the third listening position;

(v) at the second listening position, measuring direct sound produced by multiple loudspeakers in the loudspeaker assembly and evaluating whether the direct sound produced by the multiple loudspeakers is cancelled in accordance with the predetermined cancelling condition at the second listening position;

(v) if the direct sound produced by the multiple loudspeakers is not cancelled in accordance with the predetermined cancelling condition at the second listening position, adjusting one or more of the angular offsets and returning to step (i).

The invention also includes any combination of the aspects and preferred features described except where such a combination is clearly impermissible or expressly avoided.

BRIEF DESCRIPTION OF THE DRAWINGS

Examples of these proposals are discussed below, with reference to the accompanying drawings in which:

FIG. 1(*b*) is a series of 2D polar plots showing the direct sound (sound pressure level) produced by the cardioid loudspeaker assembly 1001 of FIG. 1(*a*) at different frequencies, along with the polarity of each lobe.

DETAILED DESCRIPTION

In general, the following discussion describes examples of our proposals that provide a loudspeaker assembly enclosure including a number of loudspeakers at predefined angles, where every loudspeaker unit receives an appropriate signal. A preferred aim is to obtain a given directional sound radiating.

In general terms, the present examples may be viewed as building on the concept of the cardioid loudspeaker assembly 1001 described with reference to FIG. 1(*a*).

In the examples discussed below, a number of speakers mounted in an enclosure have a geometry (mounting angles) that is dictated by the directivity of each loudspeaker.

In some examples, four or more loudspeakers may be mounted in a loudspeaker assembly enclosure in such a way that sound produced by each loudspeaker is radiating out from the enclosure in a controlled manner in the horizontal plane. In these examples, sound may radiate out from the enclosure in an arbitrary manner in the vertical plane—if control in this vertical plane were wanted, then this may be achieved by mounting additional loudspeakers in the vertical plane, e.g. with a second and third row (and possibly additional rows) of loudspeakers.

In some examples, the specific signal processing for each loudspeaker may be tuned or adapted, dictated by the directivity of each loudspeaker unit, by the mounting angle of the loudspeakers, and by the desired polar pattern of the complete enclosure.

In some examples, the loudspeakers may be mounted also with a certain angle relative to a z-direction where the z direction is defined as being an axis orthogonal to the upper plane of the enclosure.

In some examples, the signal processing for each loudspeaker may be a delay, a gain, and a filter, whose parameters have to be defined in function of the target directivity, directivity of the individual loudspeaker units and the mounting angles.

In some examples, the directivity of the loudspeaker assembly may change in function of frequency, e.g. for low frequencies (e.g. below 150 Hz), all loudspeaker units may have the same driving signal, so that low frequencies are reproduced by all loudspeakers in the loudspeaker assembly.

Figure 2:
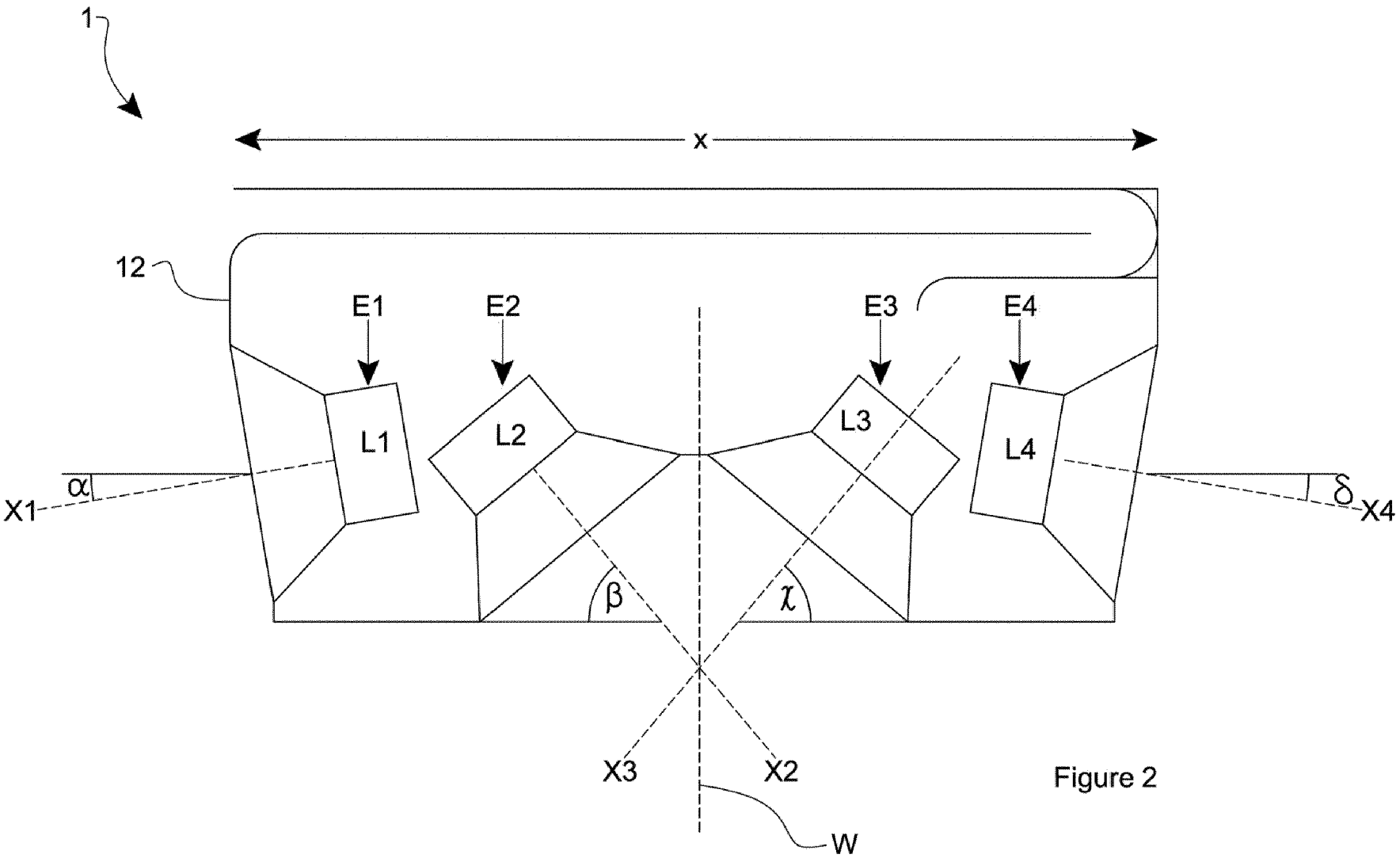
FIG. 2 shows a loudspeaker assembly according to the present invention.

FIG. 2 shows an example loudspeaker assembly 1 that includes four loudspeakers L1, L2, L3, L4 mounted within a single loudspeaker assembly enclosure 12. For reasons discussed below, the loudspeaker may be referred to as providing a "hyper directional loudspeaker enclosure".

The loudspeakers L1, L2, L3, L4 are arranged in a linear array, with each loudspeaker L1, L2, L3, L4 preferably being mounted within its own individual loudspeaker enclosure so that back radiation from each loudspeaker L1, L2, L3, L4 does not have a significant influence on other loudspeakers in the loudspeaker assembly 1.

As shown in FIG. 2, each loudspeaker L1, L2, L3, L4 has a respective principal radiating axis X1, X2, X3, X4 along which it produces sound.

As is also shown in FIG. 2, there is a first angular offset between the first and second principal radiating axes X1, X2, a second angular offset between the first and third principal radiating axes X1, X3, and a third angular offset between the first and fourth principal radiating axes X1, X4.

It can be seen from FIG. 2 that there is an angular offset between the principal axes of each pair of loudspeaker in the loudspeaker assembly that is at least a 30°.

The distance between L1 and L4 is preferably no more than 50 cm.

Each loudspeaker L1, L2, L3, L4 is configured to receive a respective electrical signal E1, E2, E3, E4 from a control unit (not shown), based on an input signal representative of audio (not shown). The control unit may be a DSP, for example.

In this example, a first electrical signal E1 received by the first loudspeaker L1 is unfiltered, but the control unit is configured to filter second, third and fourth electrical signals E2, E3, E4 received (respectively) by the second, third and fourth loudspeakers L2, L3, L4 such that there is a first gain and phase difference between the first and second electrical signals E1, E2, a second gain and phase difference between the first and third electrical signals E1, E3, and a third gain and phase difference between the first and fourth electrical signals E1, E4.

Figure 1A:
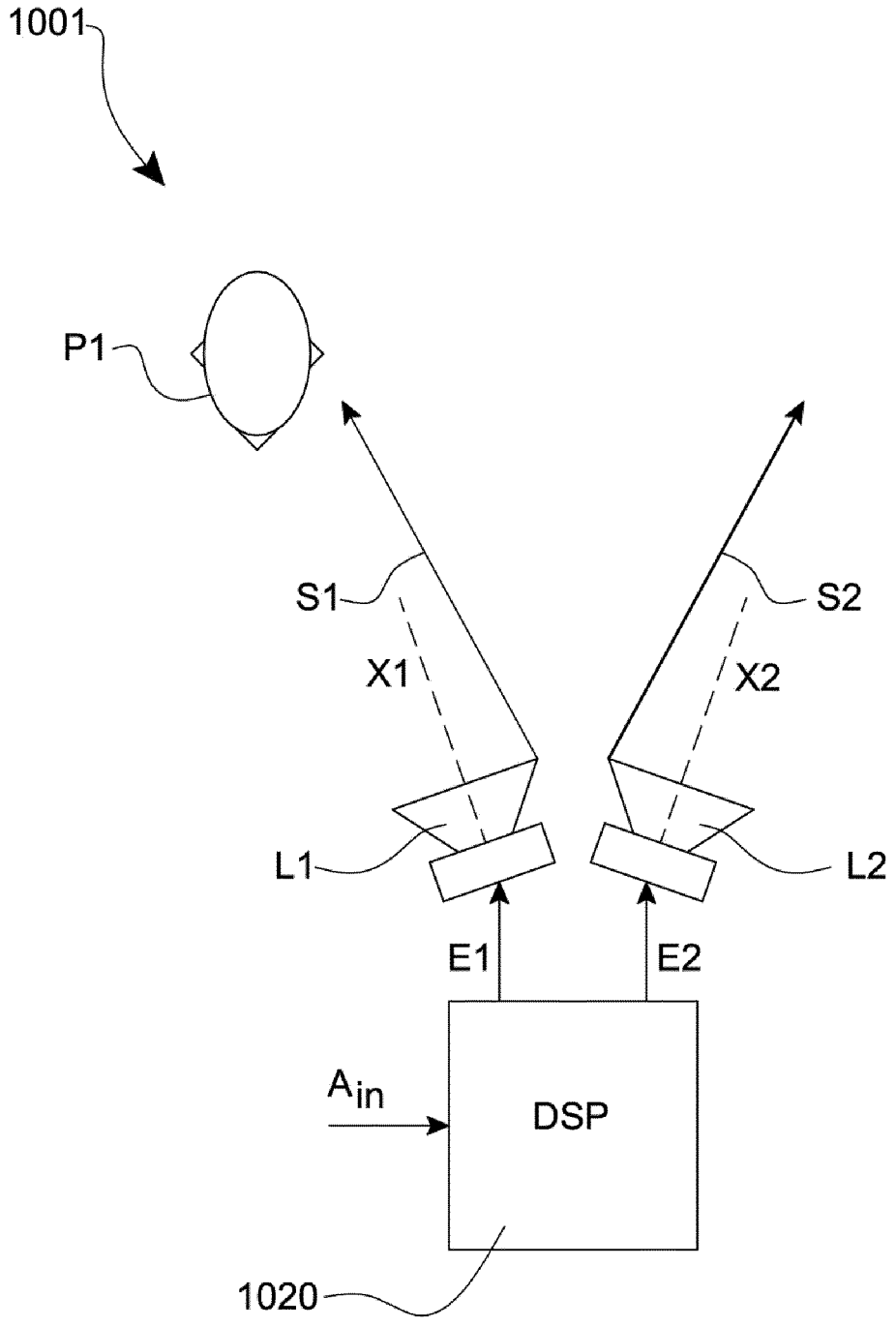
FIG. 1(*a*) shows a cardioid loudspeaker assembly.
Figure 1B:
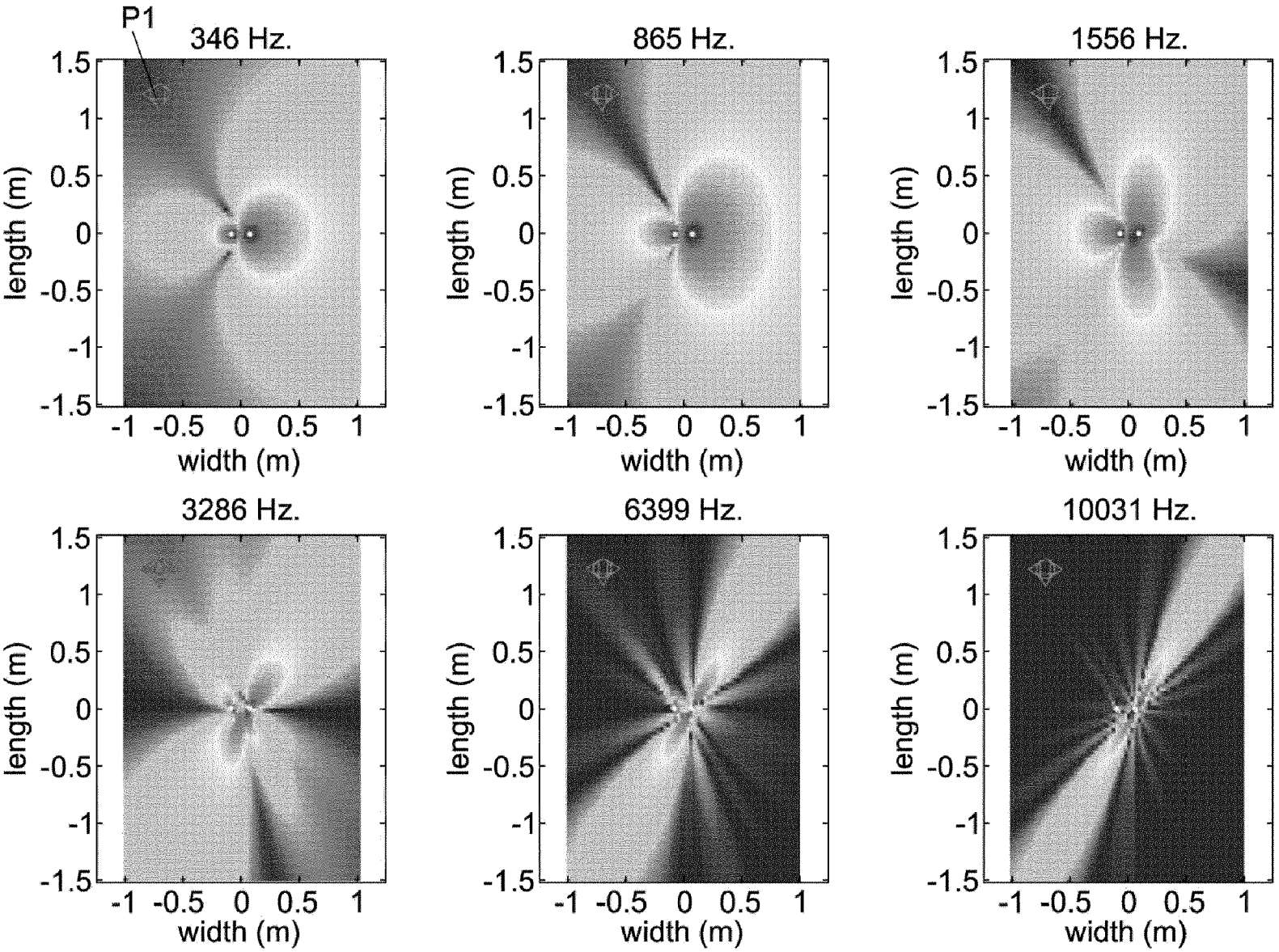
Figure 3:
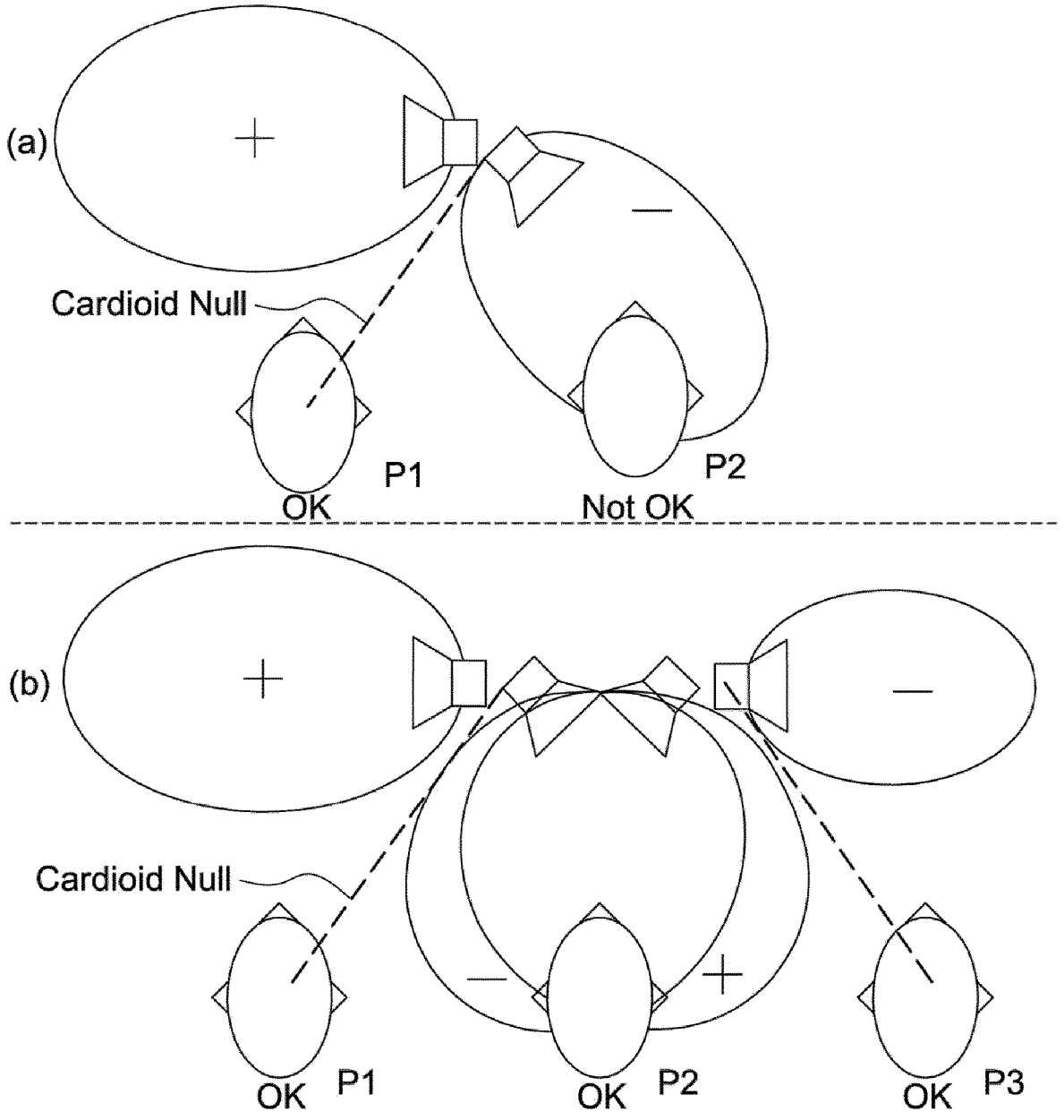
FIG. 3 compares the operation of (a) the cardioid loudspeaker assembly of FIG. 1(*a*) with (b) the operation of the loudspeaker assembly of FIG. 2.

FIG. 3 compares the operation of (a) the cardioid loudspeaker assembly 1001 of FIG. 1(*a*) with (b) the operation of the loudspeaker assembly 1 of FIG. 2.

As shown in FIG. 3(*a*), whilst direct sound produced by the loudspeakers in a cardioid loudspeaker assembly may cancel at a first listening position P1, the direct sound will in general not cancel in an adjacent listening position P2, at least not across a wide range of frequencies. Thus, only a listener positioned at the first listening position P1 will perceive sound produced by the cardioid loudspeaker assembly in a mainly reflective (indirect) way.

In contrast, FIG. 3(*b*) shows the loudspeaker assembly 1 of FIG. 2 which is preferably configured, e.g. according to the method described below, so that direct sound produced by the loudspeakers in the loudspeaker assembly cancel at first, second and third listening positions P1, P2, P3. Thus, a listener positioned at any of the first, second or third listening positions P1, P2, P3, or indeed between such positions, will perceive sound produced by the loudspeaker assembly 1 in a mainly reflective (indirect) way.

Figure 4:
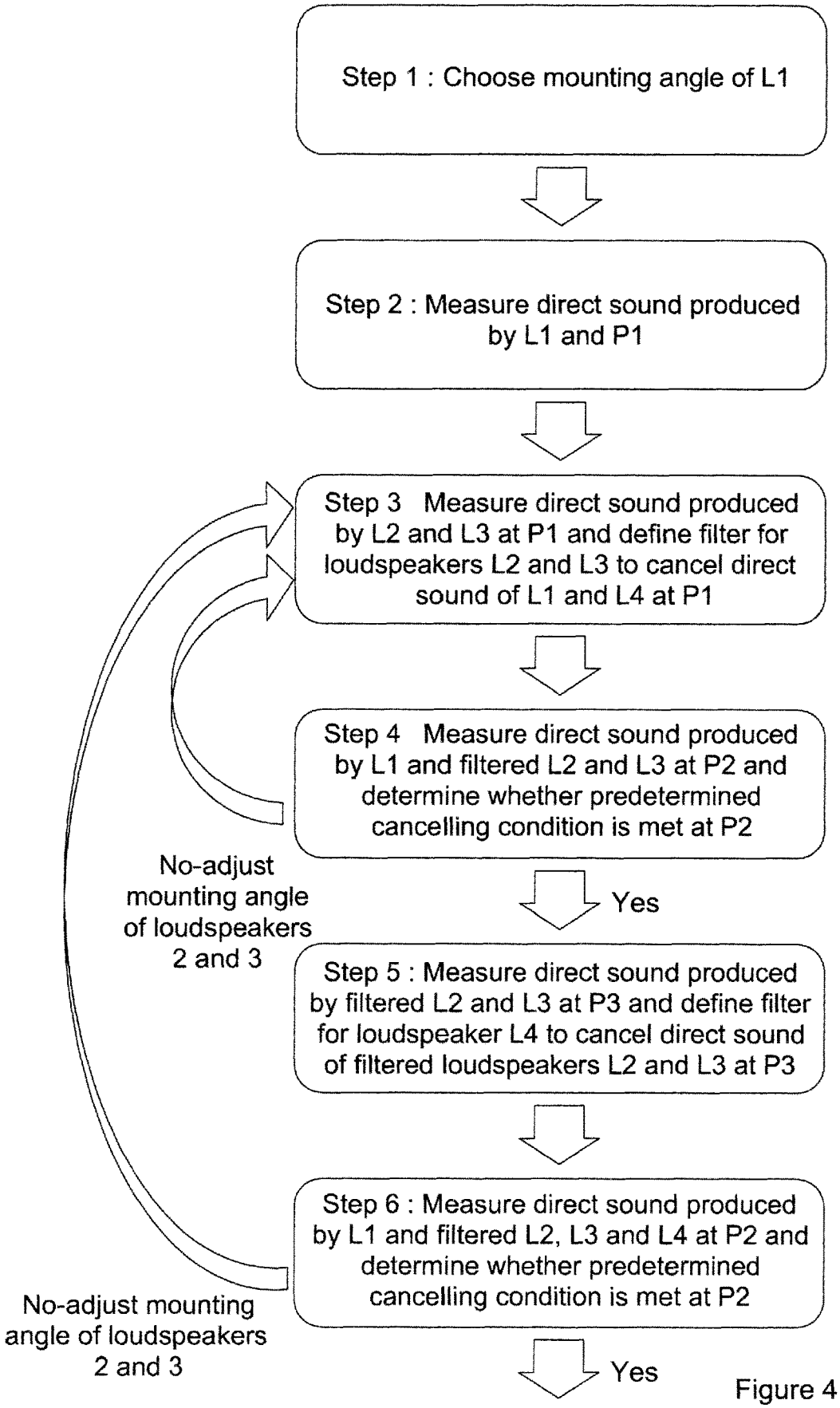
FIG. 4 shows an example method of configuring the loudspeaker assembly of FIG. 2.

FIG. 4 shows an example method for configuring the loudspeaker assembly 1 of FIG. 2 to obtain the operation shown in FIG. 3(*b*).

Initial mounting angles of the loudspeakers L1, L2, L3, L4 may be chosen to provide a good starting point for obtaining cancellation of direct sound at each listening position, e.g. as shown in FIG. 2. The loudspeakers L1, L2, L3, L4 preferably have a directivity index (according to the above definition) that is at least 6 dB at a frequency of 3 kHz, preferably so that loudspeaker L4 can be deemed to have an insignificant effect at listening position P1 and so that loudspeaker L1 can be deemed to have an insignificant effect at listening position P3 (as described below).

In Step 1, a mounting angle is chosen for loudspeaker L1. Loudspeaker L4 may be mounted to have its principal radiating axis X4 symmetrically arranged in relation to the principal radiating axis X1 in relation to a plane of symmetry W, if stereophonic sound is wanted.

In Step 2, the direct sound produced by loudspeaker L1 at listening position P1 is measured.

In Step 3, the direct sound produced by loudspeakers L2 and L3 at listening position P1 is measured, and a respective filter F2, F3 is defined for each of loudspeakers L2 and L3 so that the phase and amplitude of the direct sound produced by loudspeaker L1 and filtered loudspeakers L2, L3 at listening position P1 is cancelled in accordance with a predetermined cancelling condition (that requires the sound pressure level of direct sound produced by loudspeakers L1, L2, L3 at listening position P1 over 200 kHz-3 kHz to be at least 12 dB lower than the sound pressure level of direct sound produced by loudspeaker L1 at listening position P1). The effect of loudspeaker L4 at listening position P1 is ignored, since the angle of its principal radiating axis X4, its directivity index, and the subsequent filtering of this loudspeaker (see Step 5) mean that the effect of direct sound produced by loudspeaker L4 at listening position P1 is deemed to be insignificant.

In Step 4, the direct sound produced by loudspeaker L1 and the direct sound produced by filtered loudspeakers L2 and L3 is measured at listening position P2 to determine whether the direct sound produced by loudspeakers L1, L2, L3 at listening position P2 is cancelled in accordance with the predetermined cancelling condition (that requires the sound pressure level of direct sound produced by loudspeaker L1, L2, L3 at listening position P2 over 200 kHz-3 kHz to be at least 12 dB lower than the sound pressure level of direct sound produced by loudspeaker L1 at listening position P2).

If yes, the method proceeds to Step 5.

If no, then the mounting angle of loudspeakers L2 and L3 is adjusted (preferably with these loudspeakers having principal radiating axes that are symmetrical in relation to the plane of symmetry W) and the method returns to Step 3 until at Step 4 the direct sound produced by loudspeaker L1 and filtered loudspeakers L2 and L3 at listening position P2 is cancelled in accordance with the predetermined cancelling condition.

In Step 5, the direct sound produced by filtered loudspeakers L2 and L3 at listening position P3 is measured, and a filter F4 is defined for loudspeaker L4 so that the phase and amplitude of the filtered direct sound produced by loudspeakers L2, L3, L4 at listening position P3 is cancelled in accordance with the predetermined cancelling condition (that requires the sound pressure level of direct sound produced by loudspeakers L2, L3, L4 at listening position P3 over 200 kHz-3 kHz to be at least 12 dB lower than the sound pressure level of direct sound produced by loudspeakers L2, L3 at listening position P3). The effect of loudspeaker L1 at listening position P3 is ignored, since the angle of its principal radiating axis and its directivity index mean that the effect of direct sound produced by loudspeaker L1 at listening position P3 is deemed to be insignificant.

In Step 6, the direct sound produced by loudspeaker L1 and the filtered direct sound produced by loudspeakers L2, L3, L4 at listening position P2 is measured to determine whether the direct sound produced by loudspeakers L1, L2, L3, L4 at listening position P2 is cancelled in accordance with the predetermined cancelling condition (that requires the sound pressure level of direct sound produced by loudspeaker L1-L4 at listening position P2 over 200 kHz-3 kHz to be at least 12 dB lower than the sound pressure level of direct sound produced by loudspeaker L1 at listening position P2).

In the above method, direct sound is preferably measured in anechoic conditions, to avoid the influence of reflections.

Figure 5:
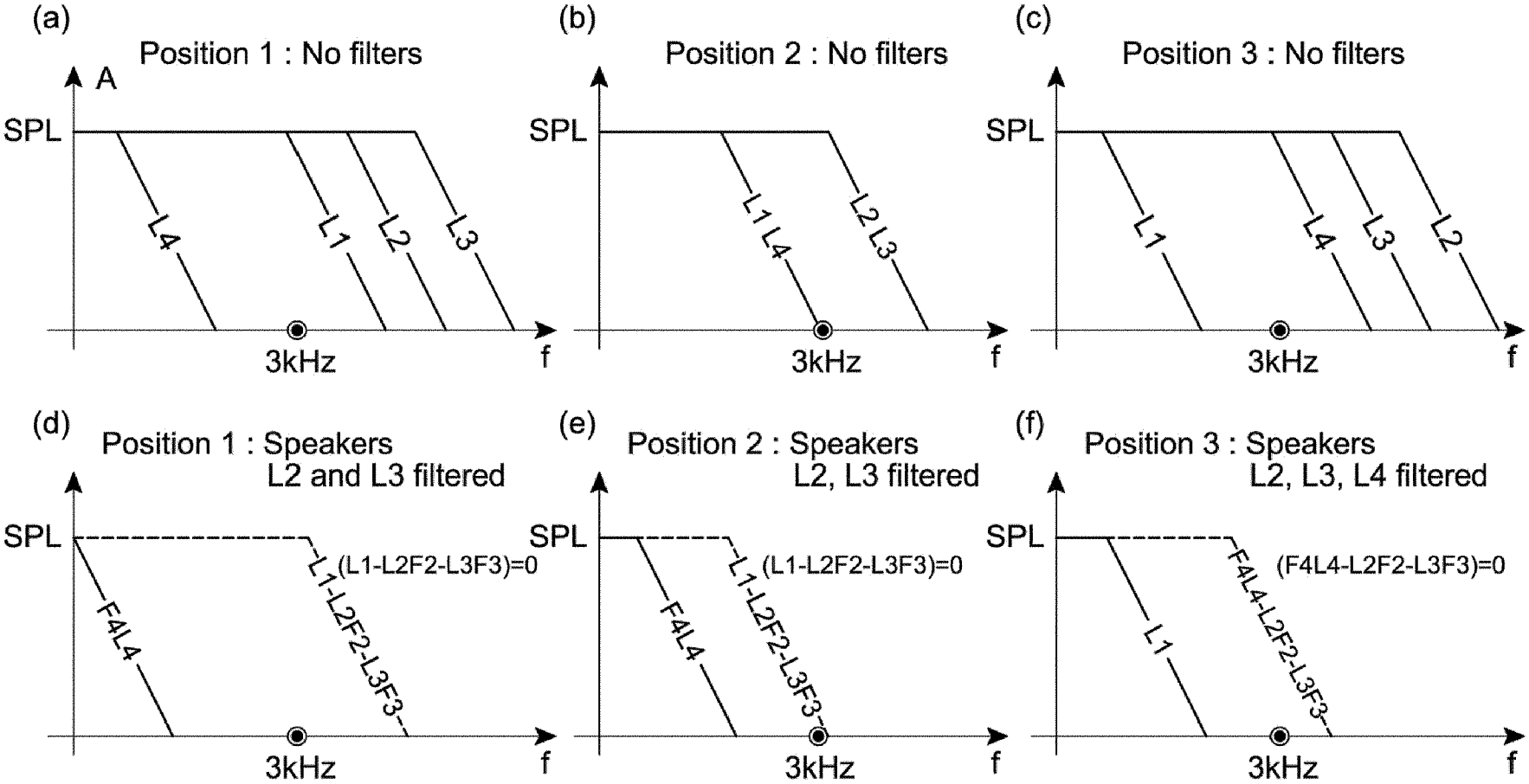
FIG. 5 is a schematic diagram that provides a simplified visualisation of the cancellation that occurs at listening positions P1-P3 when filtering derived according to the method of FIG. 4 is applied to electrical signals E1-E4 received by loudspeakers L1-L4 from the loudspeaker assembly of FIG. 2.

FIG. 5 is a schematic diagram that provides a simplified visualisation of the cancellation that occurs at listening positions P1-P3 when filtering derived according to the method of FIG. 4 is applied to electrical signals E1-E4 received by loudspeakers L1-L4 from the loudspeaker assembly of FIG. 2.

Each chart in FIG. 5 shows sound pressure level ("SPL") against frequency ("f"), with L1 being used as a reference (0 dB).

Only amplitude is depicted in FIG. 5. The effect of phase differences caused by applying filters is to cause the cancellation shown by dotted lines in FIG. 5(*d*)-(*f*).

In FIG. 5(*a*)-(*c*), the sound pressure level at listening positions P1-P3 is shown when no filtering is applied to the electrical signals received by loudspeakers L1-L4. The different amplitude characteristics of the different loudspeakers shown in these figures is therefore caused solely by the mounting angle and directivity indices.

In FIG. 5(*d*)-(*f*), the sound pressure level at listening positions L1-L3 is shown when the filtering derived according to the method of FIG. 4 is applied to the electrical signals received by loudspeakers L1-L4 (note: according to the method of FIG. 4, no filtering is applied to loudspeaker L1). For the purpose of this figure, direct sound produced by a filtered loudspeaker is represented as L+F (e.g. so direct sound produced by L2 is represented as L2+F2).

As described above, the filtering, directivity index and mounting angle of the loudspeakers L1-L4 is chosen so as to achieve cancelling of direct sound at listening positions P1-P3.

Although there is some residual sound at listening positions P1-P3, the residual sound pressure level is adequately low, and the cancellation of direct sound at these positions has the effect of increasing the proportion of sound received at those positions indirectly from reflections of the audio signals off walls at the periphery of the enclosed space. Such reflections can acts as virtual sound sources, thereby improving the listening experience of audience member(s).

In more detail, at listening position P1 (see FIGS. 5(*a*) and 5(*d*)) the sound of loudspeaker L1 is cancelled by the direct sound produced by filtered loudspeakers L2, L3. The direct sound produced by filtered loudspeaker L4 at listening position P1 is adequately low, and doesn't contribute significantly to the observation at position P1. The directivity index of the loudspeakers, the mounting angle and the electrical filtering are chosen as described above, so that cancellation of direct sound occurs at P1.

At listening position P2 (see FIGS. 5(*b*) and 5(*e*)), filtered loudspeaker L2 is producing more direct sound at listening position P2 than at listening position P1, while loudspeaker L3 is producing less direct sound at listening position P2 than at listening position P1. Careful choice of mounting angle and directivity of the speakers as described according to the iterative process described above has the effect of direct sound from filtered loudspeakers L2, L3 cancelling direct sound produced by loudspeaker L1 at listening position P2, whilst maintaining the cancelling of direct sound produced by loudspeaker L1 at listening position P1. Direct sound produced by filtered loudspeaker L4 is deemed adequately low to be ignored at listening positions P1 and P2 (although the direct sound produced by filtered loudspeaker L4 is later taken into account at listening position P2, see Step 6 in FIG. 4).

At listening position P3 (see FIGS. 5(*c*) and 5(*e*)), direct sound produced by filtered loudspeaker L2 is dominant over direct sound produced by filtered loudspeaker L3 and is now cancelled by direct sound produced by filtered loudspeaker L4. This is possible by careful adjustment of filtering, mounting angle and directivity, as described previously.

Figure 6:
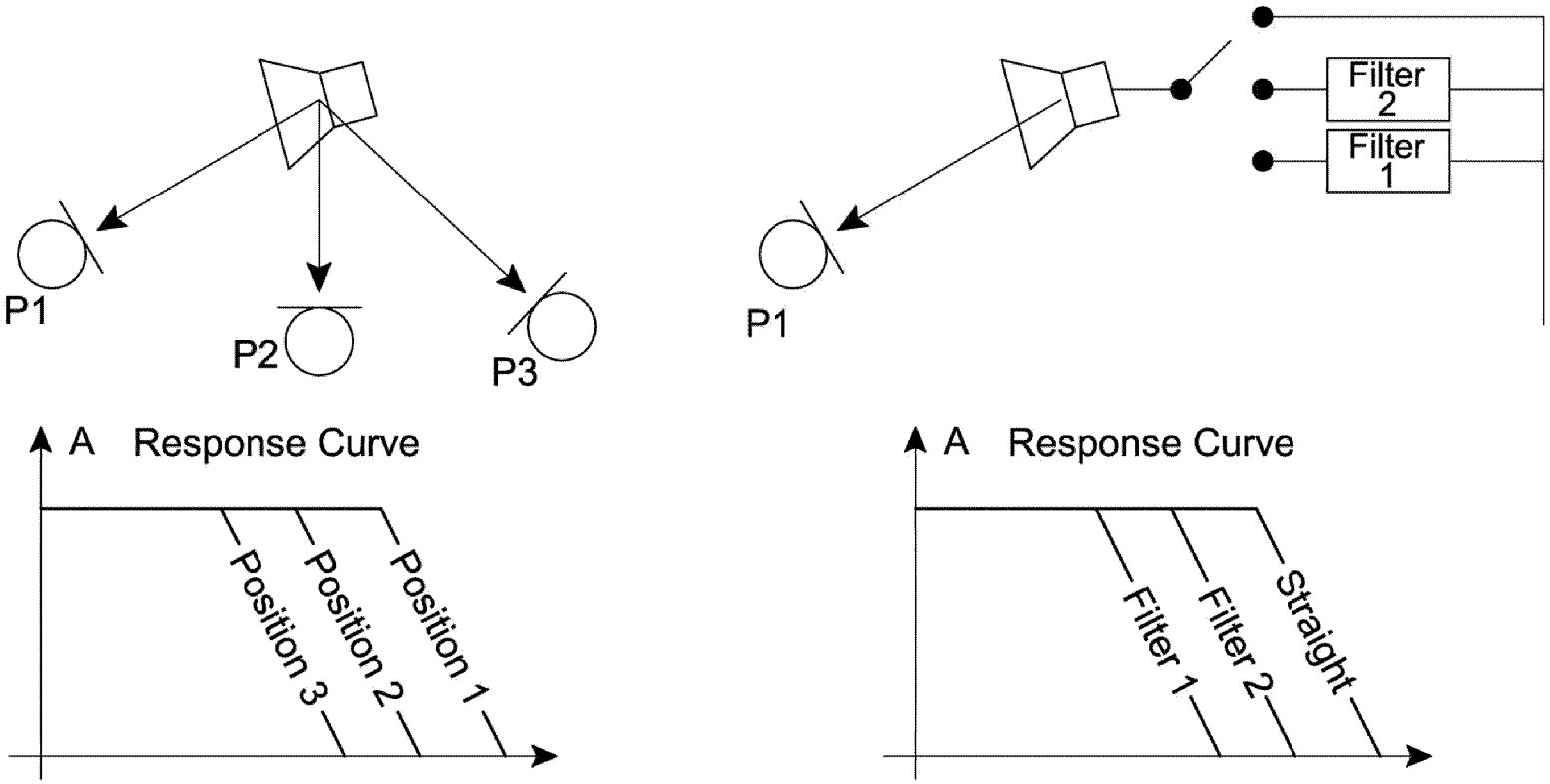
FIG. 6 illustrates the similarity in effect on the sound pressure level of direct sound produced by a loudspeaker at a listening position caused by either (i) increasing the angle between the principal radiating axis of the loudspeaker relative to the position of the loudspeaker; or (ii) filtering the electrical signal received by the loudspeaker to cancel the direct sound produced by another loudspeaker in the same loudspeaker array.

FIG. 6 illustrates the similarity in effect on the sound pressure level of direct sound produced by a loudspeaker at a listening position caused by either (i) increasing the angle between the principal radiating axis of the loudspeaker relative to the position of the loudspeaker; or (ii) filtering the electrical signal received by the loudspeaker to cancel the direct sound produced by another loudspeaker in the same loudspeaker array.

In FIG. 6, "filter 1" is a filter configured to cancel direct sound from L1 at sound at P3 and "filter 2" is a filter configured to cancel sound at P2. Hence, the response curve of the direct sound produced by L1 at P1 when filter 1 is applied is the substantially same as the unfiltered ("straight") direct sound produced by L1 at P3, and the response curve of the direct sound produced by L1 at P1 when filter 2 is applied is the substantially same as the unfiltered direct sound produced by L1 at P2.

This figure can help to explain the relationship between mounting angle and electrical filtering to create the desired radiation characteristics of each loudspeaker at the target positions, and also explains, for example, why the direct sound produced by loudspeaker L4 will have less of an effect at listening position P2 than the direct sound produced by loudspeaker L1.

When used in this specification and claims, the terms "comprises" and "comprising", "including" and variations thereof mean that the specified features, steps or integers are included. The terms are not to be interpreted to exclude the possibility of other features, steps or integers being present.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

All references referred to above are hereby incorporated by reference.

The invention claimed is:

1. A loudspeaker assembly comprising:

a first loudspeaker configured to receive a first electrical signal, and to produce sound along a first principal radiating axis based on the first electrical signal;

a second loudspeaker configured to receive a second electrical signal, and to produce sound along a second principal radiating axis based on the second electrical signal;

a third loudspeaker configured to receive a third electrical signal, and to produce sound along a third principal radiating axis based on the third electrical signal; and wherein the loudspeaker assembly is configured to produce each of the first, second and third electrical signals based on an input signal representative of audio;

wherein there is a first angular offset between the first and second principal radiating axes and a second angular offset between the first and third principal radiating axes;

wherein the loudspeaker assembly is configured to filter at least two of the first, second and third electrical signals so that there is a first gain and phase difference between the first and second electrical signals and a second gain and phase difference between the first and third electrical signals;

wherein the first and second angular offsets and the first and second gain and phase differences are configured so that, when the loudspeaker assembly is in use, direct sound produced by multiple loudspeakers in the loudspeaker assembly is cancelled in accordance with a predetermined cancelling condition at each of a first listening position and a second listening position;

wherein the loudspeaker assembly is configured for use in an enclosed space where one or more audience members are located at the first or second listening positions or between such positions so that the/each audience member receives mainly sound received indirectly from reflections of sound produced by the loudspeaker assembly off walls at the periphery of the enclosed space, and where the one or more audience members are the only audience members in the enclosed space.

2. The loudspeaker assembly of claim 1, wherein the loudspeaker assembly includes:

a fourth loudspeaker configured to receive a fourth electrical signal, and to produce sound along a fourth principal radiating axis based on the fourth electrical signal; and wherein the control unit is configured to produce the fourth electrical signal based on the input signal representative of audio;

wherein there is an third angular offset between the first and fourth principal radiating axes;

wherein the control unit is configured to filter the fourth electrical signal so that there is a third gain and phase difference between the first and fourth electrical signals;

wherein the first, second and third angular offsets and the first, second and third gain and phase differences are configured so that, when the loudspeaker assembly is in use, direct sound produced by multiple loudspeakers in the loudspeaker assembly is cancelled in accordance with a predetermined cancelling condition at each of a first listening position, a second listening position and a third listening position;

wherein the one or more audience members are located at the first or second or third listening positions or between such positions so that the/each audience members receives mainly sound received indirectly from reflections of sound produced by the loudspeaker assembly off walls at the periphery of the enclosed space.

3. The loudspeaker assembly of claim 1, wherein each loudspeaker in the loudspeaker assembly has a directivity index that is at least 6 dB at a frequency of 3 kHz.

4. The loudspeaker assembly of claim 1, wherein each gain and phase difference is zero below 150 Hz.

5. The loudspeaker assembly of claim 1, wherein the predetermined cancelling condition at each listening position requires that, over a frequency range of 200 Hz-3 kHz, the sound pressure level of direct sound produced by multiple loudspeakers in the loudspeaker assembly at the listening position is at least 12 dB lower than the sound pressure level of direct sound produced by a subset of the loudspeakers in the loudspeaker assembly at the listening position.

6. The loudspeaker assembly of claim 1, wherein there is an angular offset between the principal axes of each pair of loudspeakers in the loudspeaker assembly that is at least 30°.

7. The loudspeaker assembly of claim 1, wherein the loudspeakers in the loudspeaker assembly are arranged so that between each pair of loudspeakers in the loudspeaker assembly there is a distance that is no more than 50 cm.

8. The loudspeaker assembly of claim 1, wherein the loudspeakers in the loudspeaker assembly are mounted within a single loudspeaker assembly enclosure, with the listening positions located outside the loudspeaker assembly enclosure.

9. The loudspeaker assembly of claim 8, wherein the loudspeaker assembly includes four loudspeakers arranged in a linear array mounted within a single loudspeaker assembly enclosure, wherein the two loudspeakers on the ends of the linear array have principal radiation axes that point out from opposing side faces of the single loudspeaker assembly enclosure, with the two loudspeakers interior of the two loudspeakers on the ends of the linear array having principal radiation axes that point out of a front face of the single loudspeaker assembly enclosure, wherein the front face of the single loudspeaker assembly enclosure faces the listening positions.

10. The loudspeaker assembly of claim 8, wherein the loudspeaker assembly enclosure has a bar shape and is configured as a soundbar.

11. The loudspeaker assembly of claim 1, wherein each loudspeaker is an electro-dynamic loudspeaker that includes:

a permanent magnet assembly comprising metal components and a permanent magnet;

a voice coil assembly comprising a wire referred to as a voice coil wound/wrapped around a thin tube referred to as a voice coil former;

a diaphragm;

a chassis;

a suspension system which suspends the diaphragm from the chassis;

wherein the voice coil is configured to interact with a static magnetic field of the permanent magnet when an electric current is passed through the voice coil such that an interaction between the voice coil and the static magnetic field of the permanent magnet results in movement of the voice coil along a predetermined axis.

12. The loudspeaker assembly of claim 1, wherein each loudspeaker in the loudspeaker assembly is mounted within its own individual loudspeaker enclosure so that back radiation from each loudspeaker does not have a significant influence on other loudspeakers in the loudspeaker assembly.

* * * * *